United States Patent [19]

Persson

[11] 3,937,551

[45] Feb. 10, 1976

[54] CONNECTION BLOCK

[76] Inventor: Harry Persson, Färjemansgatan 15A, 831 00 Ostersund, Sweden

[22] Filed: Apr. 4, 1974

[21] Appl. No.: 457,703

[30] Foreign Application Priority Data

Apr. 9, 1973 Sweden ..... 73049397

[52] U.S. Cl. ..... 339/210 M; 339/193 N

[51] Int. Cl.[2] ..... H01R 13/50

[58] Field of Search ..... 339/191 R, 191 A, 191 M, 339/192 R, 193 N, 194 R, 194 N, 205, 339/206 R, 206 P, 207 R, 208, 210 R, 210 M

[56] References Cited

UNITED STATES PATENTS

| | | | |
|---|---|---|---|
| 1,414,874 | 5/1922 | Graf | 339/210 M X |
| 1,950,717 | 3/1934 | Douglas | 339/210 R X |
| 3,179,915 | 4/1965 | Klassen | 339/191 A X |
| 3,380,017 | 4/1968 | Gomulka | 339/210 M X |
| 3,716,821 | 2/1973 | Appleton | 339/205 |

*Primary Examiner*—Joseph H. McGlynn
*Assistant Examiner*—Howard N. Goldberg

[57] ABSTRACT

An insulated electrical connection block, comprising a housing which encloses interconnected sleeve-shaped contact means, the contact means comprising a pair of abutting conductive sheets formed with respectively opposed radial grooves to define the sleeve-shaped contact means. The housing is formed in two cover-shaped halves which provide recesses adjacent the outer ends of the contact means.

10 Claims, 9 Drawing Figures

CONNECTION BLOCK

The present invention relates to a connection block comprising, in an insulating housing with a main supporting surface, a plurality of mutually connected sleeve-shaped contact means adapted to receive pin-shaped contact elements through corresponding receiving apertures in the housing.

The object of the invention is particularly to provide a connection block of the kind indicated above, which is especially suitable for use in school laboratory work in physics and electronics.

According to the invention all the contact means are together formed by two abutting conductive sheets having in their opposed surfaces mutually opposite depressions extending from the edges of the sheets towards the central portions thereof and completing each other to form said sleeve-shaped contact means.

The invention will now be described in more detail below with reference to the attached drawings, FIG. 1 is an elevation view of one embodiment of the connection block of the present invention.

Figure 1:
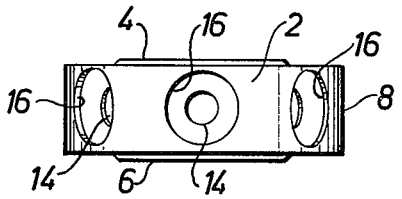
Figure 2:
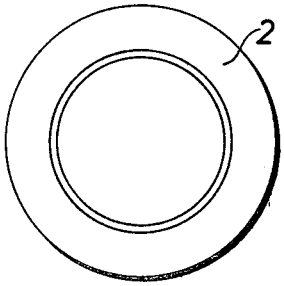
FIG. 2 is a plan view of the connection block.

The connection block 2 as illustrated in FIG. 1 and 2 comprises a round body of insulating material, e.g., plastic. The body has two parallel main support surfaces 4 and 6 and a circular mantle (edge portion) surface 8. In the body, forming a housing for the connection block, mutually connected contact sleeve means are encapsulated. The mutual connections between the contact sleeve means are provided in the manner described below. Entrance apertures 14 in the mantle surface 8 lead to one each of the contact sleeve means. The external ends of the contact sleeve means are each terminated at a distance from the mantle surface 8 in a recess 16. The recess 16 is intended for the reception of the end of the insulating grip sleeve of a plug-in contact means, the contact pin of which is to be inserted into the corresponding contact sleeve means. Accidental contact with voltage carrying parts is prevented by the fact that the contact sleeve means thus do not reach the mantle surface of the plate.

Figure 3:
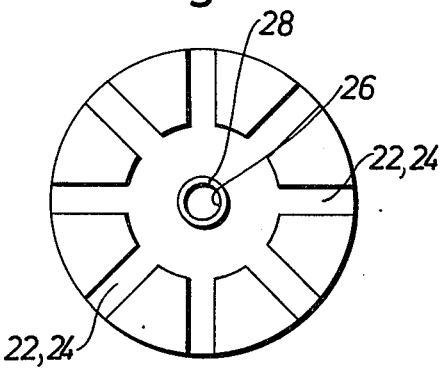
FIG. 3 is a plan view of a contact sheet which may be included as part of the contact means in the connection block illustrated in FIGS. 1 and 2.
Figure 4:
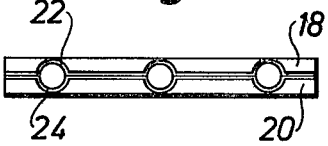
FIG. 4 is an elevation view of a contact means which consists of two of the contact sheets of FIG. 3.

In the embodiment as illustrated in FIGS. 3 and 4 the contact members included in the connection block according to the invention are all together comprised of two abutting contact sheets 18 and 20, respectively. Each contact sheet has eight radially extending grooves, or depressions, 22 and 24, respectively. Said grooves are located opposite to each other, when the sheets are in their correct mounted position, to form eight contact sleeve means. The contact sheets 18 and 20 may consist of brass and may preferably be surface treated, e.g., silver-coated.

It is easily understood that the embodiment according to FIGS. 3 and 4 presents substantial advantages by comprising only two parts, the shape of which is easily obtained by a few simple stamping and punching operations.

During production the sheets are thus stamped and punched so that the eight grooves, of semi-cylindrical cross-section, are obtained. In the centre of the sheet a hole 26 is stamped, whereafter the edges of said hole are pressed downwards to form a narrow cylindrically shaped portion 28. The object of the cylinder shaped portion 28 is to prevent the sheets from adhering to each other during the surface treatment, which may be performed in a bath with a rotating drum.

Figure 5:
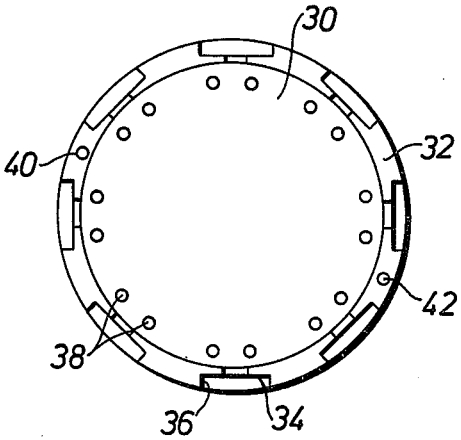
FIG. 5 is a bottom plan view showing the interior of one half of the housing adapted to enclose the contact means of FIGS. 3 and 4.
Figure 6:
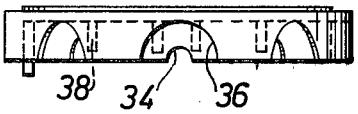
FIG. 6 is an elevation view of the one half of the connection block housing illustrated in FIG. 5.
Figure 7:
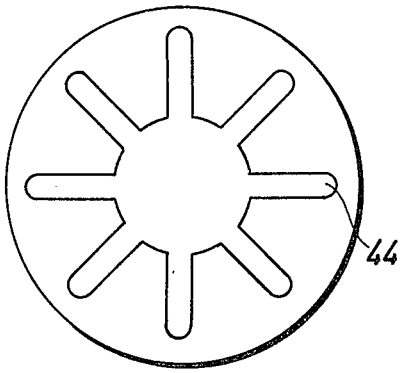
FIG. 7 is a top plan view of the one half of the connection block housing illustrated in FIGS. 5 and 6.

The housing adapted for the enclosure of the two sheets is composed of two cover-shaped halves, one of which is illustrated in FIGS. 5 through 7. Each cover has a bottom 30 and a peripheral edge 32. In the edge 32 eight semicircular notches 34 are provided. Each notch 34 is surrounded by a corresponding semi-circular recess 36 in the external side of the edge 32. When the two cover halves are assembled opposing notches 34 and recesses 36 together form holes and recesses, corresponding to apertures 14 and recesses 16 of FIG. 1, for the reception of contact pins.

At each notch 34 a pair of pressure pins 38 are provided in the bottom of each cover, said pins serving, in cooperation with opposite pressure pins in the other cover half, to press the two sheets 18 and 20 enclosed between the cover halves, against each other in the area of the grooves 22 and 24. Due to the fact that said pins are located at each side of the grooves in a sheet said pins also serve as guides for the sheets during assembly of the connection block.

Each cover presents a guide stud 40 and a diametrically opposite guide hole 42 in the edge thereof, which during assembly of the covers serve to guide the covers relative each other.

The cover may present a pattern 44 at the external side thereof, as illustrated in FIG. 7.

Figure 8:
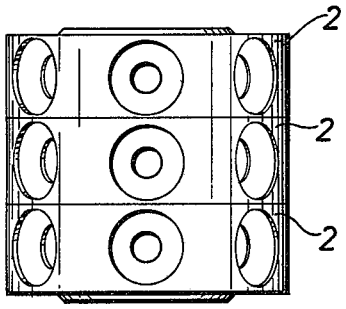
FIG. 8 is an elevation view of a stacked assembly of three connection blocks of the kind illustrated in FIGS. 1 and 2.

FIG. 8 illustrates, as an example, a three-phase connection block. The connection block shown comprises three combined sub-blocks 2 situated above each other. In this manner the contact members form three levels, which are electrically insulated from each other. Said levels may also be provided with colour markings according to standards for the phases R, S and T and, if required, for a zero connection, if there is also a fourth level.

Figure 9:
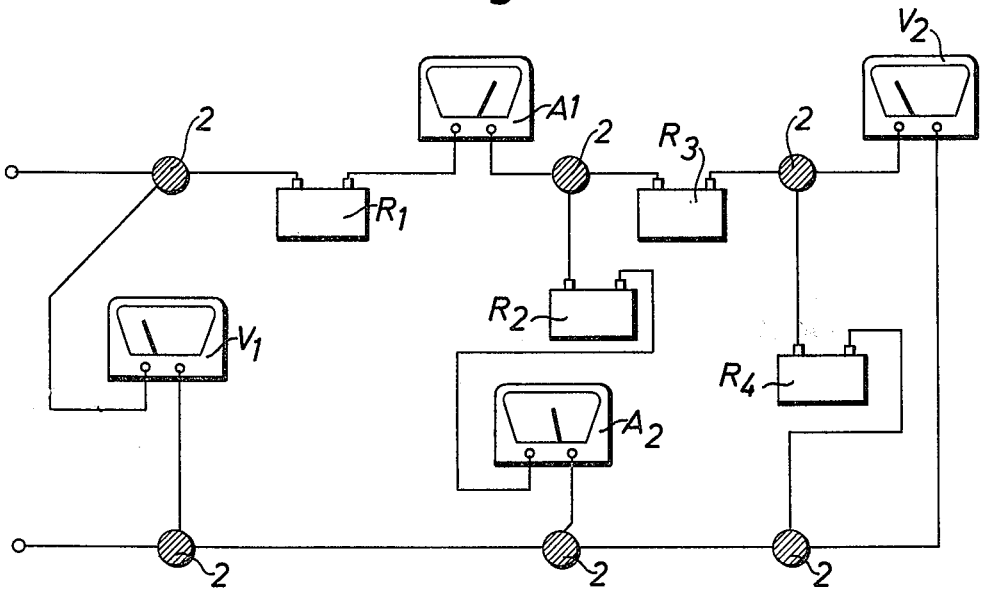
FIG. 9 is a schematic diagram of a circuit arrangement utilizing connection blocks according to the present invention.

In the example illustrated in FIG. 9 of a connection diagram, $A_1$ and $A_2$, indicate ammeters, $V_1$ and $V_2$ voltmeters and $R_1$–$R_4$ resistors. The apparatus arrangement according to this connection diagram may be realized by means of six connection blocks 2 located at one each of the junction points in the connection diagram. It is easily understood from the example illustrated in FIG. 9 that the connection block according to the invention brings pedagogic advantages in the form of improved surveyability by directly corresponding to the junction points of the connection diagram. As mentioned above, in addition, it provides improved safety against injury through electrical accidents.

It should be understood that the present invention is not restricted to the embodiments illustrated and described but may be modified within the scope of the attached claims.

While the connection block according to the invention has been said above to be especially suitable for school purposes, it should be evident that there are a plurality of other fields of application, as will be understood by a person skilled in the art.

I claim:

1. A connection block comprising an insulating housing, said housing defining a plurality of apertures around the peripheral edge portions thereof, a plurality of mutually interconnected sleeve-shaped contact means enclosed by said housing and each positioned and adapted to receive a pin-shaped contact element through one of said plurality of apertures in said housing, said plurality of interconnected contact means being integrally formed together by two abutting conductive sheets having respectively opposed grooves to define individual sleeve-shaped contact means, said housing comprising two cover-shaped parts, said cover-shaped parts each including pressure means between the inside portion of each of said cover-shaped parts and the adjacent conductive sheet for maintaining said conductive sheets pressed against each other.

2. A connection block as claimed in claim 1, wherein the conductive sheets abut one another at common plane surfaces.

3. A connection block as claimed in claim 2, wherein the grooves in said conductive sheets extend radially outwardly from the central portion thereof.

4. A connection block as claimed in claim 3 wherein the grooves in said conductive sheets extent radially outwardly at equal angular spacings about the central portions thereof.

5. The connection block as claimed in claim 3 wherein said means for maintaining the conductive sheets pressed together comprise pressure pins formed on the inside portions of said cover-shaped parts, said pressure pins also serving as rotational positioning means for the portions of said conductive sheets forming said grooves.

6. The connection block as claimed in claim 3 wherein the outer surfaces of said housing are shaped to nest with housings of additional similar connection blocks so as to make said housings stackable with one another.

7. A connection block as claimed in claim 3 wherein the outer periphery of each of said conductive sheets is round in plan view.

8. The connection block as claimed in claim 7 wherein the outer edges of said conductive sheets are substantially completely enclosed within said housing to prevent accidental contact therewith.

9. The connection block as claimed in claim 1 wherein said two conductive sheets are substantially identical.

10. The connection block as claimed in claim 1 wherein said two conductive sheets with opposed grooves define contact pin sockets substantially independent from the interior shape of said housing.

* * * * *